US006068524A

United States Patent [19]

Koumatsu

[11] Patent Number: 6,068,524

[45] Date of Patent: May 30, 2000

[54] REVERSED TERMINAL INSERTION PREVENTING STRUCTURE

[75] Inventor: Seiji Koumatsu, Shizuoka, Japan

[73] Assignee: Yazaki Corporation, Tokyo, Japan

[21] Appl. No.: 08/965,189

[22] Filed: Nov. 6, 1997

[30] Foreign Application Priority Data

Nov. 8, 1996 [JP] Japan ..... 8-296370

[51] Int. Cl.[7] ..... H01R 13/514

[52] U.S. Cl. ..... 439/752.5

[58] Field of Search ..... 439/752.5, 744, 439/595

[56] References Cited

U.S. PATENT DOCUMENTS 5,226,839 7/1993 Koumatsu et al. ..... 439/595
5,626,499 5/1997 Yagi et al. ..... 439/752.5

FOREIGN PATENT DOCUMENTS 6-58568 8/1994 Japan .

*Primary Examiner*—Paula Bradley
*Assistant Examiner*—Katrina Davis
*Attorney, Agent, or Firm*—Armstrong, Westerman, Hattori, McLeland & Naughton

[57] ABSTRACT

A reversed terminal insertion preventing structure is provided. This structure can detect reversed insertion of a terminal inserted into a connector housing upside down, and also prevent deformation of the terminal. The terminal has two protrusions for preventing reversed insertion. Two guide grooves corresponding to the two protrusions are formed on the inner walls of the terminal receiving chamber of the connector housing. When the protrusions simultaneously come into contact with the end walls of the respective guide grooves, the insertion of the terminal is stopped halfway into the connector housing. On the opposite side from the guide grooves formed on two inner walls perpendicular to each other, two escape grooves for the protrusions are formed for normal insertion.

6 Claims, 3 Drawing Sheets

FIG. 1
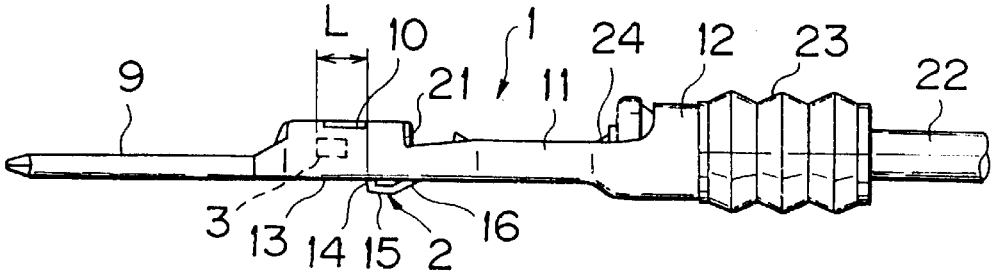
FIG. 2
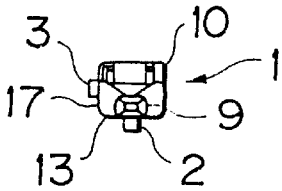
FIG. 3
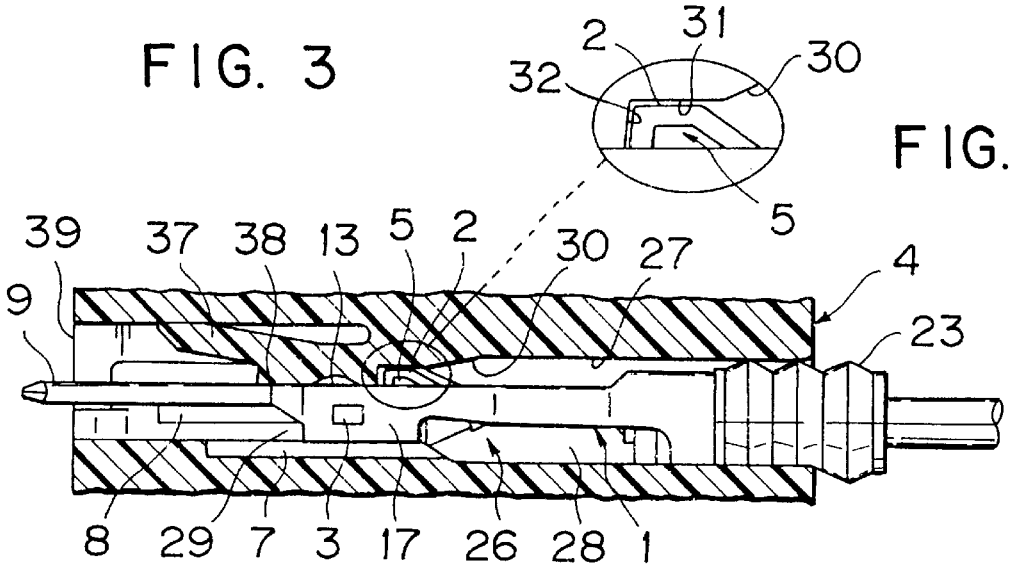
FIG. 3A

FIG. 4
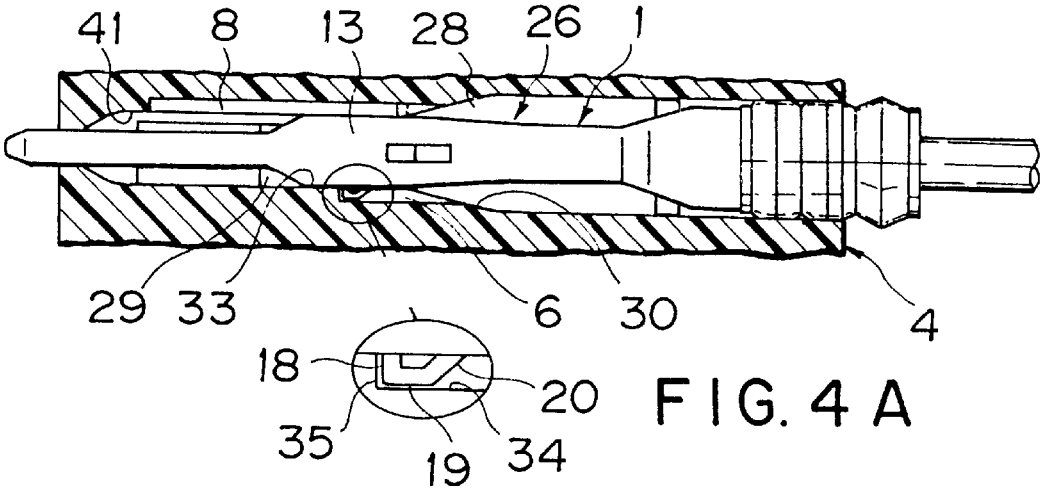
FIG. 4A
FIG. 5
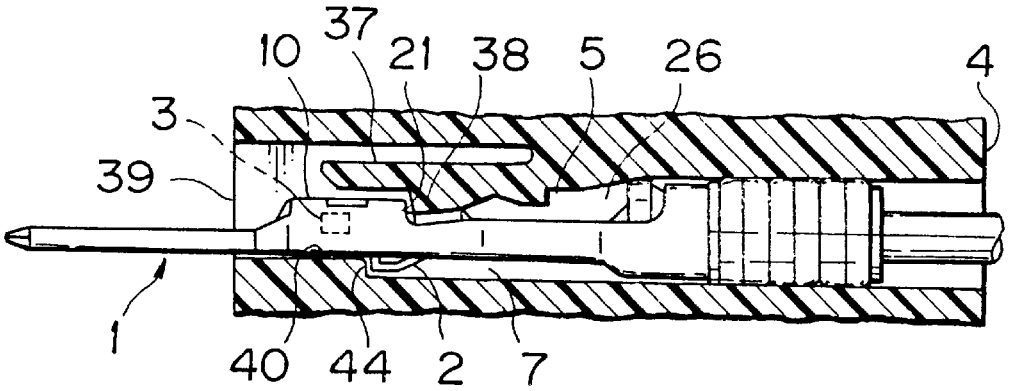
FIG. 6
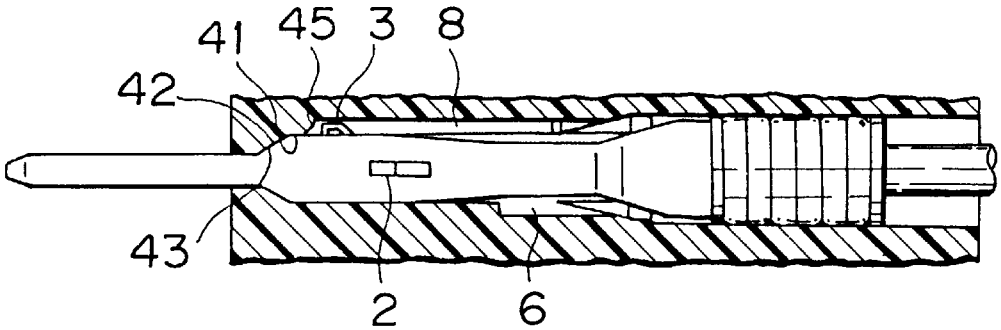

REVERSED TERMINAL INSERTION PREVENTING STRUCTURE

BACKGROUND OF THE INVENTION

1. Field of the Invention

The present invention relates to a reversed terminal insertion preventing structure which can detect reversed insertion from contacts between a projection of a terminal with a part of a connector housing when the terminal is inserted into the connector housing upside down.

2. Description of the Related Art

FIGS. 7 and 8 show a conventional reversed terminal insertion preventing structure which is disclosed in Japanese Utility Model Application Laid-Open No. 61-80576.

This structure prevents a terminal 52 from being inserted into a synthetic resin connector housing 51 upside down. A semi-circular protrusion 53 is provided on the back of the terminal 52. A guide groove 55 is formed to accommodate the protrusion 53 at the bottom of the terminal receiving chamber 54 in the connector housing 51. As shown in FIG. 7, when the terminal 52 is inserted correctly, the protrusion 53 is situated at the end of the guide groove 55.

A notch 56 is formed on the top wall 58 of the terminal receiving chamber 54 in the connector housing 51. A contact surface 57 is formed to block the protrusion 53 at the front side of the notch 56 at the mid-point on the top wall 58 in the terminal insertion direction. As shown in FIG. 8, when the terminal 52 is inserted upside down, the protrusion 53 is blocked by the contact surface 57 so as to prevent the insertion of the terminal 52 halfway. Thus, the reversed insertion of the terminal 52 can be detected.

With the conventional preventing structure, however, there is a problem that the height H (shown in FIG. 7) of the protrusion 53 cannot be increased due to the limitation of the space in the connector housing 51, and because of this, the contact area between the protrusion 53 and the contact surface 57 is small, resulting in the reversed insertion of the terminal 52. If the contact area is small, it is impossible to obtain a prevention force large enough to prevent the reversed insertion of the terminal 52. There is another problem that whether the terminal 52 is inserted correctly or upside down, the protrusion 53 hits the contact surface 57 of the notch 56 or the end surface of the guide groove 55, putting an unnecessarily large force onto the protrusion 53. Thus, only a part of the terminal 52 is subject to stress, resulting in deformation of the terminal 52.

SUMMARY OF THE INVENTION

The object of the present invention is to provide a reversed terminal insertion preventing structure which can surely prevent the reversed insertion of a terminal, and also prevent the deformation of a terminal.

To achieve the above object, the present invention provides a reversed terminal insertion preventing structure which can prevent a terminal from being inserted upside down by bringing reversed insertion preventing protrusions formed on the terminal into contact with the end surfaces of guide grooves for blocking the protrusions inside a terminal receiving chamber of a connector housing. This structure is characterized in that a plurality of protrusions are formed on two different walls of the terminal, that the positions of the plurality of protrusions are displaced in the longitudinal direction, and that the plurality of protrusions simultaneously come into contact with the end surfaces of the respective guide grooves.

Two protrusions formed on two walls perpendicular to each other may be provided. On the opposite side from the two guide grooves formed on two inner walls perpendicular to each other, two escape grooves may be provided on two remaining inner walls perpendicular to each other inside the terminal receiving chamber. The two escape grooves are used for passing the protrusions, when the terminal is inserted properly.

The above and other objects and features of the present invention will be more apparent from the following description taken in conjunction with the accompanying drawings.

BRIEF DESCRITION OF THE DRAWINGS

FIG. 1 is a side view of a terminal used in a reversed terminal insertion preventing structure of the present invention.

FIG. 2 is a front view of the terminal.

FIG. 3 is a longitudinal sectional view of the terminal inserted into a connector housing upside down with enlarged partial portion FIG. 3A.

FIG. 4 is a traverse sectional view of the terminal inserted into the connector housing upside down with enlarged partial portion FIG. 4A.

FIG. 5 is a longitudinal sectional view of the terminal inserted properly into the connector housing.

FIG. 6 is a traverse sectional view of the terminal inserted properly into the connector housing.

DESCRIPTION OF THE PREFERRED EMBODIMENTS

Figure 7:
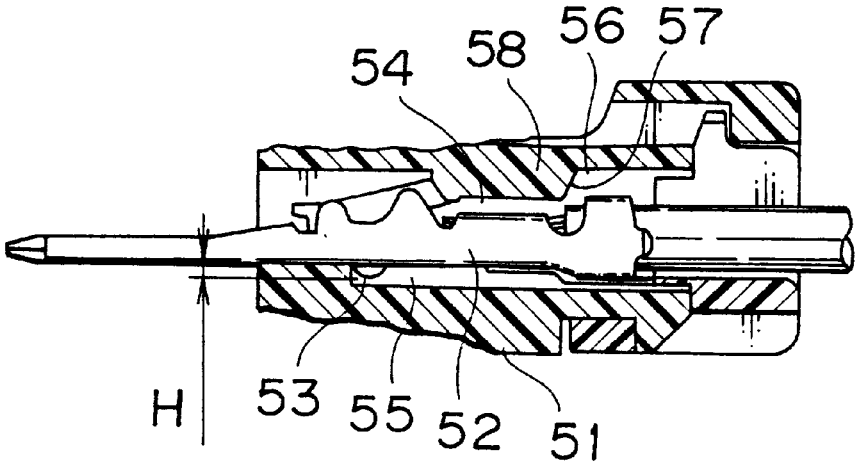
FIG. 7 PRIOR ART
FIG. 7 is a longitudinal sectional view of a conventional example of a terminal inserted into a connector housing upside down.
Figure 8:
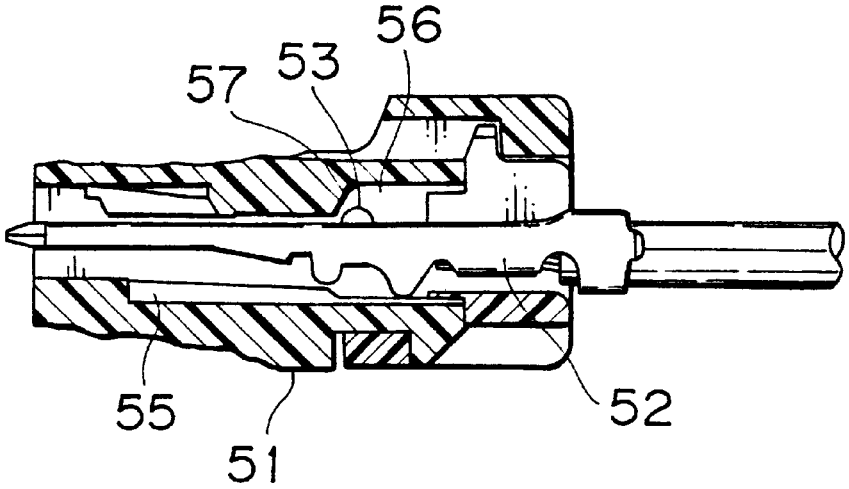
FIG. 8 PRIOR ART
FIG. 8 is a longitudinal sectional view of the conventional example of the terminal inserted into a connector housing upside down.

The following is a detailed description of an embodiment of the present invention with reference to the attached drawings.

FIGS. 1 to 6 show an embodiment of the reversed terminal insertion preventing structure of the present invention.

This structure includes a terminal 1 having reversed insertion preventing protrusions 2 and 3 on two different sides, a connector housing 4 made of a synthetic resin having reversed insertion preventing guide grooves 5 and 6 for blocking the protrusions 2 and 3, and escape grooves 7 and 8 for correct insertion.

As can be seen from FIGS. 1 and 2, the terminal 1 has a protruding contact member 9 at its front end, a box-type stop member 10 in the middle, and a wire contact bonding member 11 and a rubber stopper contact bonding member 12 at its rear end. The first protrusion 2 is formed in the rear half of the bottom wall (base member) 13 of the box-type stop member 10. The first protrusion 2 is situated in the middle of the base member 13 across the width as shown in FIG. 2, and has a contact surface 14 which is perpendicular to the base member 13 at its front end, a horizontal surface 15 in the middle, and an inclined surface 16 at its rear end, as shown in FIG. 1. The protrusion 2 is formed by cutting and pulling a portion out of the base member 13.

The second protrusion 3 is formed in the front half of a side wall 17 of the box-type stop member 10 as shown in FIGS. 2 and 3. The second protrusion 3 is formed by cutting and pulling a portion out of the side wall 17, and has a contact surface 18 which is perpendicular to the side wall 17 at its front end, a horizontal surface 19 in the middle, and an inclined surface 20 at its rear end, as shown in FIG. 4.

The protrusions 2 and 3 are formed on different walls of the terminal 1 (one is the bottom wall 13 and the other is the side wall 17), and the two walls are perpendicular to each other. The positions of the protrusions 2 and 3 are displaced by L along the length of the terminal 1 by L.

In FIG. 1, a stop member 21 is formed at the rear end of the box-type stop member 10 of the terminal 1. The front end of a waterproof rubber stopper 23 into which a wire 22 is inserted is pressed and fixed to the rubber stopper contact bonding member 12. A conductive member 24 of the wire 22 is connected by means of the wire contact bonding member 11.

FIGS. 3 and 4 show the terminal 1 inserted into a terminal receiving chamber 26 of the connector housing 4 upside down.

As shown in FIG. 3, a guide groove 5 (or a guide space) for blocking the first protrusion 2 to prevent reversed insertion is formed on the side of the top wall 27 (inner wall) along the length of the terminal receiving chamber 26. The first guide groove 5 is formed by cutting out a short portion between a wide chamber 28 for accommodating the rubber stopper 23 and a narrow chamber 29 for accommodating the box-type stop member 10 in the terminal receiving chamber 26. The first guide groove 5 has a horizontal surface 31 extending to a taper wall 30 at the end of the wide chamber and an end surface 32 (contact surface) which is perpendicular to the taper wall 30.

If the terminal 1 is inserted upside down, the first protrusion of the terminal 2, FIG. 3A, goes into the first guide groove 5 smoothly. Here, the horizontal surface of the guide groove comes into contact with the horizontal surface 15(shown in FIG. 1), while the end surface 32 blocks the contact surface 14.

As shown in FIG. 4, a second guide groove 6 for blocking the second protrusion 3 is formed on a side wall 33 (inner wall) along the length of the terminal receiving chamber 26. The second guide groove 6 is formed on a wall perpendicular to the wall on which the first guide groove 5 is formed. The second guide groove 6 is formed by cutting out a short portion between the wide chamber 28 and the narrow chamber 29 in the terminal receiving chamber 26. The second guide groove 6 has a horizontal surface 34, FIG. 4A, extending to the taper wall 30 at the end of the wide chamber, and an end surface 35 which is perpendicular to the taper wall 30. The second guide groove 6 extends toward the front edge and is longer than the first guide groove 5 by L, FIG. 1 which is the distance between the protrusions 2 and 3 of the terminal 1.

If the terminal 1 is inserted upside down, the second protrusion 3 goes into the second guide groove 6 smoothly. The second protrusion 3 goes along the horizontal surface 34, FIG. 4A toward the end surface 35, and stops when the contact surface 18 comes into contact with the end surface 35.

When the terminal 1 is inserted upside down, the second protrusion 3 goes into the second guide groove 6, and then the first protrusion 2 goes into the first guide groove 5. The protrusions 2 and 3 hit the respective end surfaces 32 and 35 of the respective guide grooves 5 and 6 at the same time. Here, the terminal 1 is stopped halfway into the terminal receiving chamber, and the insertion of the rubber stopper 23 is not complete. Thus, the incorrect insertion of the terminal 1 can be easily detected by visual inspection.

As shown in FIG. 3, a flexible stop lance 37 provided inside the terminal receiving chamber 26 of the connector housing is bent upward at 38 due to the contact with the base member 13 of the terminal 1. Here, the protruding contact member 9 of the terminal 1 is slightly projecting from the front opening 39, as shown in FIG. 4.

In this embodiment, the protrusions 2 and 3 are blocked by the end surfaces 32 and 35 of the guide grooves 5 and 6 simultaneously so that forces can be given uniformly to the protrusions 2 and 3, and that the stress on the terminal 1 can be dispersed so as to prevent deformation of the terminal 1 and damage to the protrusions 2 and 3. The two protrusions 2 and 3 add to the contact area between the guide grooves 5 and 6, and the end surfaces 32 and 35, so as to achieve sufficient reversed insertion prevention. The stress can be dispersed more efficiently by shifting the positions of the protrusions 2 and 3 not only in the longitudinal direction, but also in the circumferential direction. It is also possible to improve the stress dispersion by disposing the protrusions 2 and 3 substantially in the middle of the respective walls 13 and 17.

Three or more protrusions situated in different positions will improve the stress dispersion and reversed insertion prevention. The number of protrusions in this embodiment is two, because the escape groove 7 and 8 are necessary in the opposite positions from the guide grooves 5 and 6.

FIGS. 5 and 6 show the terminal 1 inserted into the connector housing 4 correctly.

As shown in FIG. 5, a first escape groove 7 (a third guide groove) is formed in the insertion direction of the terminal 1 to accommodate the first protrusion 2 on the bottom wall 40 (inner wall) of the terminal receiving chamber 26 of the connector housing 4. The first escape groove 7 corresponds to the first guide groove 5 in the case where the terminal 1 is inserted upside down. The first escape groove 7 extends toward the front edge beyond the stop lance 37, and is sufficiently longer than the first guide groove 5.

As shown in FIG. 6, a second escape groove 8 is formed in the insertion direction of the terminal 1 to accommodate the second protrusion 3 on another side wall 41 (inner wall) of the terminal receiving chamber 26 of the connector housing 4. The second escape groove 8 corresponds to the second guide groove 6. The first escape groove 7 and second escape groove 8 are formed on two walls perpendicular to each other. The second escape groove 8 extends to the vicinity of the taper member 42 leading to the front opening 39 of the terminal receiving chamber, and is sufficiently longer than the second guide groove 6.

If the terminal 1 is inserted correctly, the rear side member 21 of the box-type stop member 10 is blocked by the stop lance 37 as shown in FIG. 5, and the taper member 43 at the edge of the box-type stop member 10 comes into contact with the taper member 42 of the terminal receiving chamber 26 as shown in FIG. 6. By doing so, the terminal 1 is positioned in the insertion direction. The protrusions 2 and 3 do not necessarily come into contact with the end surfaces 44 and 45 of the respective escape grooves 7 and 8, and a slight gap remains between the protrusion 2 and the end surface 44, and between the protrusion 3 and the end surface 45. The protrusions 2 and 3 are positioned by engaging with the respective escape grooves 7 and 8 formed on two walls perpendicular to each other, so that they can be positioned in the circumferental direction. The end surfaces 44 and 45 may contact with the protrusions 2 and 3 so that the terminal 1 is positioned in the inserting direction.

As described so far, according to the present invention, a plurality of protrusions simultaneously come into contact with the end surfaces of the guide grooves. As a result, the contact area between the protrusions and the end surfaces can be increased as well as the reversed insertion prevention (a force to prevent the reversed insertion of a terminal). Accordingly, even if the height of each protrusion cannot be increased due to the limitation of the space, it is possible to obtain a reversed insertion preventing force so as to surely prevent a terminal from being inserted upside down. Also, by shifting the positions of the protrusions, stress concentration onto one part of the terminal can be avoided when the protrusions come into contact with the end surfaces of the guide grooves. Thus, the stress can be dispersed to prevent the terminal from being deformed and damaged. According to the present invention, it is also possible to keep the connector housing small and to maintain the strength of the connector housing, because the guide grooves and the escape grooves are situated on the four inner walls of the terminal receiving chamber one by one.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A terminal insertion preventing structure for preventing inserting of a terminal into a connector housing when the terminal is reversed and for inserting a terminal into the connector housing when the terminal is not reversed, comprising reversed insertion preventing protrusions formed on and extending radially outward from said terminal, spaced axially along said terminal and extending from different sides of said terminal, perpendicular to each other, said connector housing having an inner wall with guide grooves for simultaneously blocking said protrusions formed on and extending radially outward from said terminal when said terminal is reversed and is inserted into said connector housing and escape grooves for correct insertion when said terminal is not reversed and is inserted into said connector housing.

2. A terminal insertion preventing structure according to claim 1, wherein two said protrusions are formed on different walls of said terminal, respectively, which walls are faced to said guide grooves and are perpendicular to each other, and escape grooves for allowing said two protrusions to pass, when said terminal is inserted, are formed on the remaining two inner surfaces of said terminal receiving chamber.

3. A terminal insertion preventing structure according to claim 1, wherein each protrusion has a contact face which is perpendicular to a bottom face of said terminal and a horizontal face which is parallel to the bottom face of said terminal.

4. A terminal insertion preventing structure according to claim 1, wherein each protrusion is formed integrally with the corresponding side of the terminal.

5. A terminal insertion preventing structure according to claim 1, wherein each guide groove extends from a wide portion to a narrow portion.

6. A terminal insertion preventing structure according to claim 1, wherein each guide groove has a horizontal bottom face and a contact face on an end surface which is perpendicular to the horizontal bottom face.

* * * * *